United States Patent [19]

Miller

[11] 4,345,545

[45] Aug. 24, 1982

[54] APPARATUS FOR ELECTRON CURING OF RESIN COATED WEBS

[75] Inventor: Alton K. Miller, Niagara Falls, N.Y.

[73] Assignee: The Carborundum Company, Niagara Falls, N.Y.

[21] Appl. No.: 172,722

[22] Filed: Jul. 28, 1980

[51] Int. Cl.[3] ..... B05B 5/02

[52] U.S. Cl. ..... 118/621; 250/492.1; 427/44; 422/186

[58] Field of Search ..... 250/492 R, 505, 517, 250/527; 427/44, 35, 36, 372.2; 118/65, 620, 621

[56] References Cited

U.S. PATENT DOCUMENTS

| | | | |
|---|---|---|---|
| 2,741,704 | 4/1956 | Trump et al. . | |
| 2,956,904 | 10/1960 | Hendricks | 117/93 |
| 3,022,543 | 2/1962 | Baird, Jr. | 18/57 |
| 3,081,485 | 3/1963 | Steigerwald | 18/1 |
| 3,330,748 | 7/1967 | Lawton | 204/158 |
| 3,433,947 | 3/1969 | Emanuelson et al. | 250/442 |
| 3,564,238 | 2/1971 | Martin | 250/49.5 |
| 3,628,987 | 12/1971 | Nakata | 117/47 A |
| 3,673,409 | 6/1972 | Green . | |
| 3,676,249 | 7/1972 | Lemelson | 156/244 |
| 3,846,149 | 11/1974 | Meunier | 427/44 |
| 3,925,671 | 12/1975 | Austin et al. | 250/400 |
| 4,047,903 | 9/1977 | Hesse et al. | 51/298 R |

FOREIGN PATENT DOCUMENTS

| | | | |
|---|---|---|---|
| 2101682 | of 0000 | France . | |
| 2294036 | of 0000 | France . | |
| 2298166 | of 0000 | France . | |
| 1109023 | of 0000 | United Kingdom . | |
| 1168641 | of 0000 | United Kingdom . | |
| 1509069 | 4/1978 | United Kingdom | 427/44 |
| 2031700 | of 0000 | United Kingdom . | |

OTHER PUBLICATIONS

"Products Finishing", (I) Jan. 1970, pp. 130–134.
"Products Finishing", (II) Aug. 1971, pp. 92–95.
Elektrotechnik & Maschinenbau, vol. 8–28 94, No. 5, May 1977, pp. 189, 190.
"Paper Film & Foil Converter", Dec. 1979, vol. 53, No. 12, pp. 45, 47, 48, 49, 50, 54.
"Radiation Processing", R. S. Mellberg, 1978–SRI International Research Report 618, pp. 21, 22, 23, 27, 28.
The Handbook of HV Electron Beam Processing, pp. 1–3.
Radiation Dynamics Inc. Publication, pp. 14, 15.
Energy Sciences Inc. Electrocurtain Processors, 2 pp., 3 pp.
Energy Sciences Inc. Electrocurtain Processors, 2 pages.

*Primary Examiner*—John H. Newsome
*Attorney, Agent, or Firm*—Paul A. Leipold; R. Lawrence Sahr

[57] ABSTRACT

There is disclosed a radiation vault enclosure comprising a radiation resistant structure, means for a web of material to enter said structure, means to carry said web past a source of electron beam radiation in said structure, means for said web to leave said structure and access means for a person to enter said radiation resistant structure for cleaning of the said means to carry said web. In a preferred embodiment the path of a curable resin coated web material through the chamber may be adjusted to provide electron radiation either to the wet resin side of the web or the back side of the web to cure the resin.

8 Claims, 5 Drawing Figures

APPARATUS FOR ELECTRON CURING OF RESIN COATED WEBS

BACKGROUND OF THE INVENTION

1. Field of the Invention

The invention relates to apparatus for curing resin material onto continuous webs of cloth or paper material. The invention particularly relates to the formation of coated abrasive materials and the curing of backing coats on cloth or paper which will be used for formation of coated abrasives.

2. Prior Practices

It is known in the coated abrasive art to apply binder and abrasive grains to a paper or cloth substrate which is cured yielding sufficient strength for the following applications, subsequently the size coat is applied and the product completely cured. Suitable binders are for example glutelin glue, phenolic resins and, if water proof papers are desired, polyurethane resins, epoxy resins and alkyd resins, possibly in combination with melamine resins. Special requirements as related to technique, apparatus and time are necessary for the curing process. To avoid destruction of the substrates usually consisting of polyester or cellulose, curing should be effected at a maximum temperature of 120° to 130° C. Rapid curing allowing for the use of a horizontal dryer is difficult, because of the formation of gas bubbles affecting the adhesion of the resin on the substrate. The drying of the coated material sufficient to be rolled for curing generally requires several hours, and is therefore carried out in a festoon oven. The festoon oven through which the coated web material is passing, enable a long drying or partial cure process, but there are also disadvantages, such as the formation of defects where the material is suspended, sagging of the binder and changing of the grain position due to the vertical suspension, variation of temperature and the resulting inconsistant crosslinking of the binder produced by the necessary slow air circulation. After removal from the festoon oven, it is then necessary to completely cure the rolls of partially cured abrasives by slowly heating in an auxiliary oven. Slow heating is necessary to prevent an uneven cure caused by widely different temperatures between the outside and inside of the rolls.

It is also known to produce abrasives by coating a substrate using a heat polymerizable curable synthetic resin as well as abrasive grains and by subsequently curing the applied layer by means of infrared radiation. The relatively long curing period of the synthetic resin is a disadvantage of this processing method. Owing to the long curing period and the elevated temperature the substrate is also strongly attacked. Furthermore the processing speed is low during the production of abrasives.

There are several disadvantages of the predominant commercial practice of forming coated abrasives. There are several curing steps in the typical process for formation of waterproof cloth-backed abrasives. The major areas of production may be considered as first the cloth treatment to prepare resin treated base cloth for application of abrasives and second the making of the coated abrasives using the previously prepared base cloth. The base cloth is coated with at least one backing coat of resin which impregnates the cloth with resin and fills interstices in the back of the cloth. The backing cloth is also coated with at least one face coat that fills interstices of the cloth on the side where abrasive grain is placed. The face coat(s) of the backing cloth also aids in adhesion of the coats containing the grains onto the cloth.

The second major area of coated abrasive formation is the drying or partial curing of the make coat which contains the grain and drying or partial cure of the size coat which is an overcoat placed onto the coated abrasive after the grain is at least partially cured and adhered onto the backing by the make coat. There may be pre-size coats prior to the make and size coats utilized in some instances. The partial curing of the make and size coats as set forth above generally is done in a lengthy festoon dryer that requires a tremendous amount of floor space and energy. Further, both the festoon and auxiliary ovens where the curing takes place over a long period are difficult to completely control for accurate temperature. There also is the problem of the resin and grain shifting positions during curing because of the long hang times in the partially cured or uncured form. Then after removal from the festoon oven, further energy is used in the oven treatment of the rolls to obtain complete cure.

It has been suggested in the U.S. Pat. No. 4,047,903 Hesse et al that the formation of coated abrasives be carried out with at least one layer of the resin being cured by electron beams. However, there has remained a need for apparatus which would allow the commercial exploitation of electron beam curing. Hesse et al does not set forth apparatus that would allow the continuous formation of coated abrasives. There are extensive difficulties in commercial exploitation of electron beam curing. The conventional electron beam units are not accessible for easy cleaning. The conventional units do not allow rapid adjustment for curing from either side of the web carrying the coated abrasive. The installations may be bulky with walls of cement about 3 feet thick. Further, the conventional electron beam units do not allow easy stringing of new web material into the machine for rapid changeovers from one material to another.

When forming coated abrasives, there may be required very thick coats of resin compared with prior uses of the electron beam. The resins necessary also are very sticky prior to being completely cured. Therefore, multiple path systems such as disclosed in some prior electron beam curing systems such as U.S. Pat. No. 3,022,543 are not satisfactory since if the resins touch a roller the system will gum-up and not perform. Another difficulty with the formation of abrasives with electron beam curing apparatus such as presently available is that in coated abrasive formation there is always a certain amount of abrasive grain which becomes detached from the coated abrasive during formation and can detrimentally affect the equipment if it is not possible to regularly clean and maintain the equipment. The equipment becomes contaminated by adhesive buildup and by material such as abrasive grit and dirt which becomes embedded in the abrasive. Another difficulty is that generally coated abrasives are made with multiple changes of grit size, backings and resin coatings. Therefore it is necessary to stop and start the system at relatively frequent intervals. Present systems of electron beam curing, designed for use in other arts, do not allow rapid cleaning and restringing of webs in the equipment. Therefore, if used for coated abrasives, the amount of up time would be so short as to not be economical.

Therefore there remains a need for apparatus which will allow formation of coated abrasives in a low-cost commercially satisfactory manner.

BRIEF DESCRIPTION OF THE INVENTION

It is an object of this invention to overcome disadvantages of the prior methods and apparatus for forming resin coated webs of paper and cloth.

It is a further object of this invention to overcome disadvantages of the prior methods and apparatus for forming coated abrasives.

It is another object of this invention to form improved coated abrasives.

It is a further object of this invention to form apparatus for electron beam curing which may be quickly cleaned.

It is an additional object of this invention to form apparatus for forming coated abrasives which may be easily threaded with webs.

It is another further object of this invention to form electron beam curing apparatus which is quickly serviced.

It is another further object of this invention to construct electron beam continuous curing apparatus which is an unrestricted radiation area for those working in the area.

It is another further object of this invention to provide electron beam curing in a continuous manner for coated cloth and coated abrasive materials.

It is an additional further object of the invention to provide improved continuous uniform coating of backing materials for coated abrasives.

It is an additional object of this invention to provide apparatus for electron beam curing of resin coated webs with only a small loss in "up" time for the cleaning of the apparatus.

It is a further object of the invention to provide electron beam apparatus for curing of the size coat for coated abrasives from either side.

It is an additional object of this invention to provide electron curing of resin cloth finish coats from either side of the cloth.

It is again an object of this invention to provide continuous make-coating and abrasive grain application to webs in apparatus for electron beam curing, from either web side, in the formation of coated abrasives.

It is another object of this invention to provide improved uniform continuous coated abrasive materials.

These and other objects of the invention are generally accomplished by providing a source of high energy electron radiation which is mounted in a chamber that comprises a series of boxes which are large enough to allow quick servicing of the electron beam unit and also ease of access by a person into the unit for cleaning and threading of the portions of the device which carry the web of coated abrasive into and from the chamber. Further the apparatus of the invention allows easy adjustment to directly impinge the high energy electrons onto either side of the web material without the necessity of the web material having its uncured resin side contact a roller. The device also allows the use of one device for the four steps of coating both the backing coating and face coating onto a cloth to be used for coated abrasives and both the make and size coating in coated abrasive formation utilizing the same apparatus. The apparatus of the invention may be set up either to apply and cure a fill face coat, or fill backing coat or to apply the make coat, apply abrasive grain and cure the make coat, or to apply and cure a size coat over the abrasive grain. Further the apparatus of the invention may be set up to cure the resin make and size coats or backing and face fill material from either the wet resin side or from the back of the substrate away from the wet side.

DETAILED DESCRIPTION OF THE INVENTION

There are numerous advantages in the system of the instant invention. The apparatus of the instant invention allows the web wet with resin to be irradiated from either side by the electron beam without need for the wet web to touch a roll prior to being cured. The apparatus of the invention allows adjusting and viewing of the web as it moves through the apparatus prior to activation of the electron beam. Further the instant apparatus allows easy servicing of the electron beam gun without lengthy shut-down times. The instant apparatus also allows cleaning of abrasive materials from the apparatus with convenience and speed. The area around the apparatus during operation is below 25 millirems per hour so as to be safe without the need for radiation badging of employees in the area. The device of the instant invention also allows the versatility to cure material from either the face or backside and to form coated abrasives by two passes (make and size) of continuous lengthy web materials with the necessity of only utilizing one electron beam chamber even if the subsequent passes must be with irradiation from opposite sides of the web. A further advantage of the instant system is that the device while it is easily accessed for maintenance, set-up and cleaning, the use of inerting gas is relatively low as there is a small gas box in the irradiation zone which is the only area inerted. Inerting is necessary as oxygen interferes with the electron beam crosslinking of resins. The operation and advantages of the apparatus of the invention will become more apparent from the following description of its operation.

Figure 1:
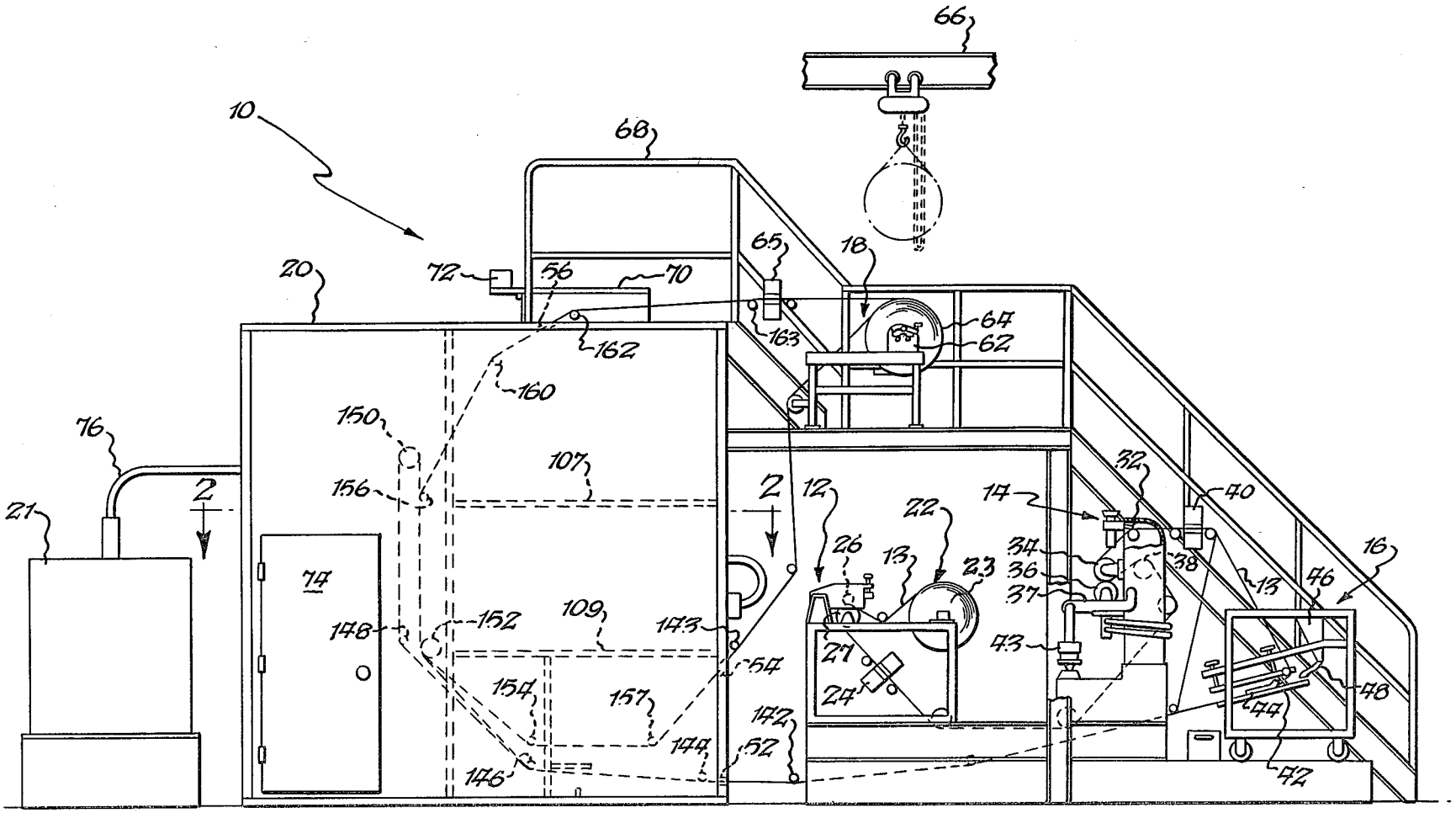
FIG. 1 is a view of the apparatus of the instant invention.

FIG. 1 illustrates the set-up of the apparatus system 10 of the invention illustrating the alternative pathways for the alternative uses of the apparatus. The apparatus 10 is composed of an unwinder 22, printer 12, coater 14, electrostatic grain applicator 16 and electron beam chamber 20. Also illustrated is the high voltage power supply 21 and winder roll 18. The unwinder 22 holds supply roll 23 into which may be placed the blank cloth to be treated with a backing coat, face coat or the resin treated cloth which will be treated with a make coat prior to putting grain on the cloth or a roll of abrasive which has grain on it but which is placed into the unwinder 22 for treatment with a size coat over the grain. The printer 12 utilizes a roll 26 to print the necessary descriptive material on the back of the cloth or paper backing. Such information as the grit size, recommended use of the coated abrasive and trademarks are printed on the backing. The print roll 26 runs against impression roll 27. Element 24 is a beta gauge device for measuring the weight of the web leaving roll 23. The coating device 14 is known in the art as is the printer 12. The coating device 14 may utilize a doctor-blade coater 32 to push a resin onto the web 13 or may use a transfer rubber roll 36 in sump 37 to apply resin to the web being passed through the apparatus. Rolls 34 and 36 are utilized to carefully control the web during coating. Beta gauge measuring device 40 measures the weight of the coating to insure the ability to control for accurate coating. Coating thicknesses of about 20 mils may be applied in coated abrasive formation. Pressure supply 43 adjusts the coating roll pressure on the web during coating to control resin weight.

After leaving the coater 14 the web if it is to be coated with abrasive grain passes to the electrostatic coater generally indicated as 16. The electrostatic coater, known in the art, comprises a system whereby abrasive grain is applied to a vibrating lower plate 42. A vibrating belt and grid could be used rather than a plate. The web 13 passes against grounded plate 44 leaving a gap between the web 13 held against plate 44 and the lower electrostatically charged plate 42. The abrasive grains are attracted by the electrostatic charge and embed themselves in the wet resin on the web 13. By this method the points of the grains are oriented upward away from the web surface for best cutting. A source of abrasive grain 46 is applied to lower plate 42 by the vibratory feeder 48. The rate of application is controlled by means not shown to provide a continuous moving layer of particles on vibratory feeder plate 42. Other electrostatic feeder arrangements may be utilized if desired.

The web 13 enters the equipment vault 20 at 52 and if radiated by the electron beam from the wet face side exits at 54 or if subjected to the electron beam from the backside exits at 56. The tracking within the equipment vault 20 will be described in more detail below. After exiting the equipment chamber where the curing by electron beam takes place the cured treated web 13 is wound onto the winder device generally indicated as 18. The winder roll 64 driven by means 62 not shown in detail gathers and rolls the treated web 13 onto a roll which may be moved by overhead hoist 66. The roll if it is to be further treated is then moved down to the location of the supply roll 22 or a finished product may be stored or moved to final shipping or cutting. The stair and railing 68 provides access to the upper portion of the radiation equipment vault and to the winder roll. Guard 70 counter-balanced by weight 72 provides shielding for the exit 56. Access door 74 provides entry for people into the radiation equipment vault for maintenance and threading of the web through the conveyor rollers and the inerting chamber. The beta gauge 65 allows measuring the weight of the total weight of make coat. The equipment vault walls are generally of 3-inch thick steel with lead lining in critical areas as will be set forth in more detail below.

Figure 2:
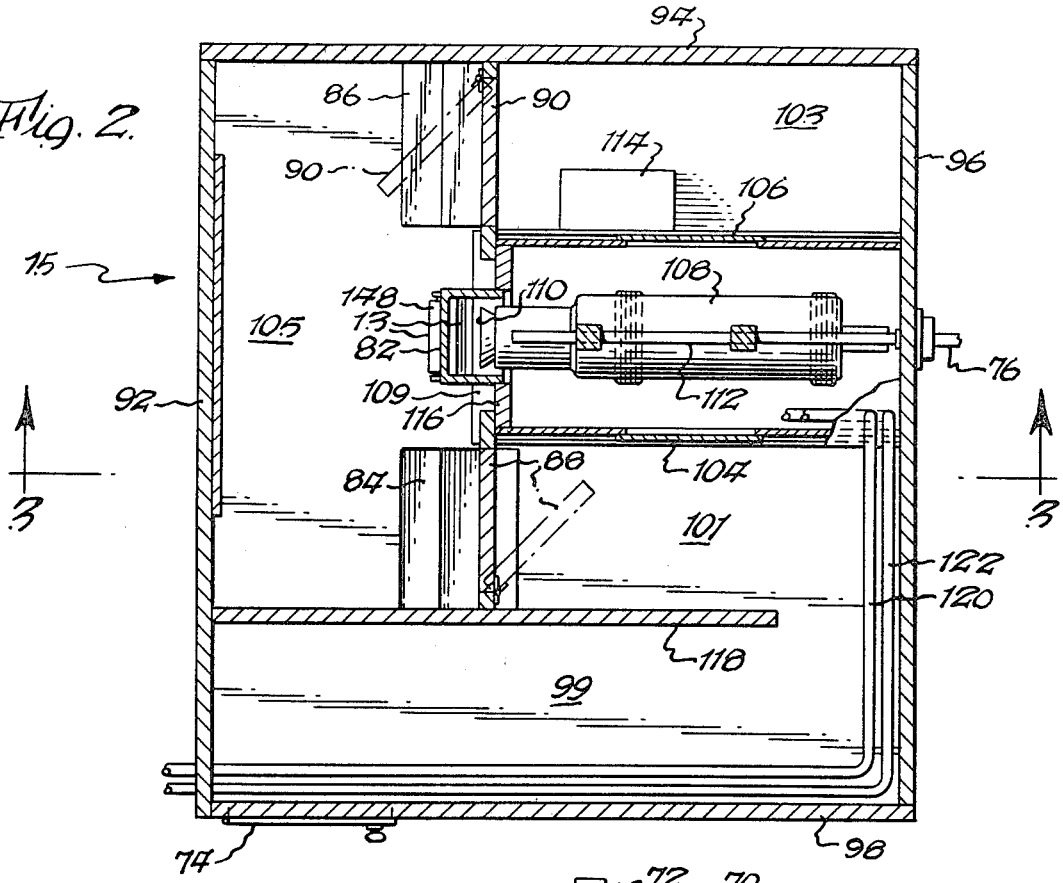
FIG. 2 is a cross section of the electron beam chamber of the invention taken along section line 2—2 of FIG. 1.
Figure 3:
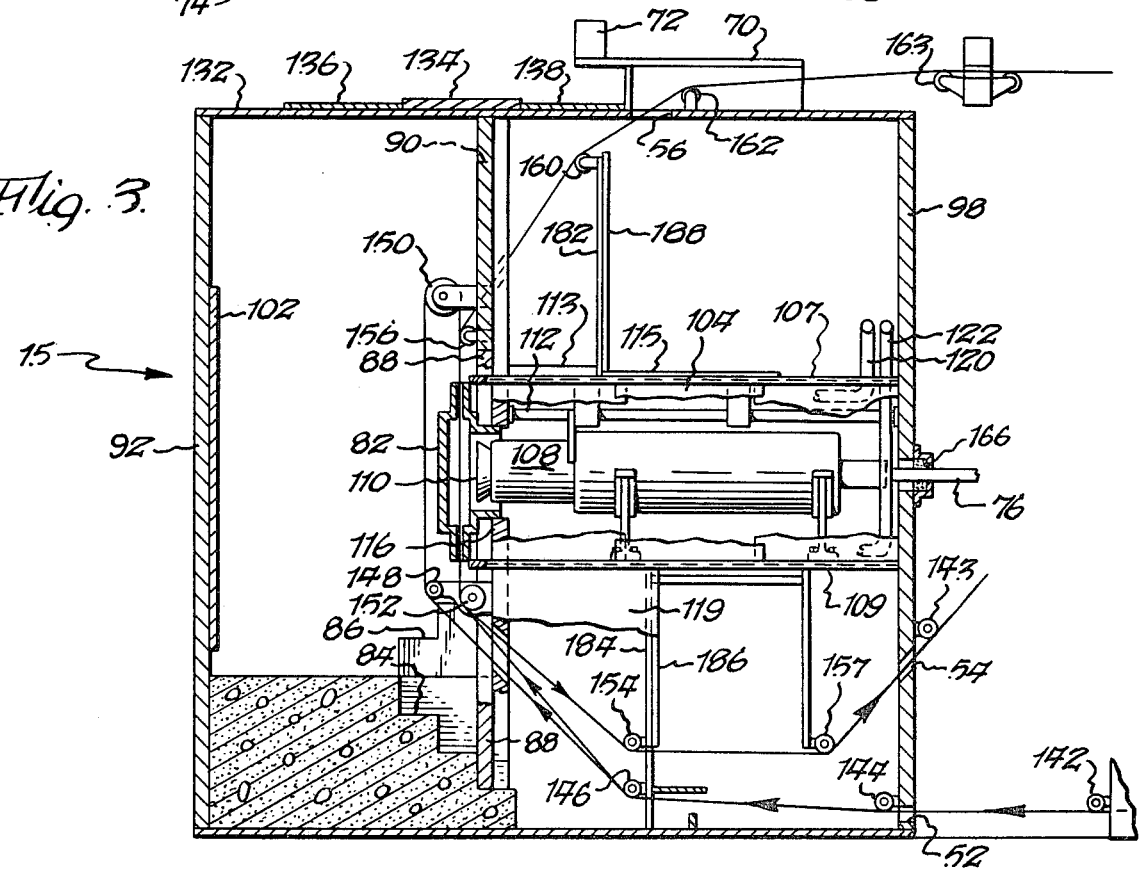
FIG. 3 is a sectional view of the electron beam chamber of the invention taken along section line 3—3 of FIG. 2.

FIGS. 2 and 3 illustrate the equipment vault housing the electron beam unit with special emphasis as to the shielding and service features of the equipment vault and electron beam curing apparatus system of the instant invention. FIG. 2 is a section along line 2—2 of FIG. 1 taken just above the electron beam curing unit. FIG. 3 is a view taken along line 3—3 of FIG. 2 that illustrates the mounting of the electron beam gun, shielding within the equipment vault for the electron beam unit and the multiple pathways for the web which allow curing from either face of the web. The radiation equipment vault generally indicated as 15 is formed of a front wall 92, back wall 96 and side walls 94 and 98. There is a door 74 in the side 98. Entrance through door 74 is into area 99 which constitutes an entrance-way and also is shielded by partition 118, commonly referred to as a maze. Partition 118 and all four sides of the equipment vault 15 as shown are formed of 3-inch thick steel. The steel is covered with lead at points of increased need for radiation control. After entry through passageway 99 the service area around the electron beam gun 108 is identified as areas 101 and 103. It is noted that areas 101 and 103 are joined above the chamber which houses the electron beam generating unit. From area 101 the target chamber 105 is entered by door 88 up stairs 84. Target chamber 105 has a floor which is at easy working level for servicing the inerting chamber 82. Further, it is noted that directly opposite the inerting chamber 82 the target area steel wall is covered with about 3 inches of lead to provide further protection from radiation in the surrounding areas. Access to area 103 is up stairs 86 through door 90. It is noted that the entire enclosure of the vault is a generally square floor area. Area 103 has easy access to service the electron beam generating unit and also to aid in stringing of the webbing to be cured by the unit 108. Step 114 aids in reaching the upper portion of the chamber for web manipulation.

The electron beam generating unit 108 is entirely enclosed within the container of which the sides 106 and 104 are illustrated in FIG. 2 and the upper and lower portions 107 and 109 are illustrated in FIG. 3. This inner chamber is formed of about 1-inch steel panels with additional radiation absorbing material comprising about 1½ inches of lead on all four sides of about the third of the chamber towards the inerting box, about one inch of additional lead on the middle third of the chamber and about ½ inch additional lead on the rear portion of the chamber. Further it is noted that the electron beam generating unit may be adjusted and moved for service along suspending steel rod 112. Tubes 120 and 122 bring cooling gases into the equipment cavity for cooling of the electron beam window. Inerting gas, as is known, is necessary for the effective electron beam curing of resins as oxygen interferes with the curing. The inerting gas, normally nitrogen, enters the inerting chamber 82 from storage tanks (not shown) outside the chamber by pipes (not shown).

With particular reference to FIG. 3 there is illustrated that the ceiling 132 of the equipment vault 15 contains additional lead shielding material. The ceiling has 2½ inches of lead over the 1 inch steel plate ceiling at the portion directly above the inerting chamber. Extending on each side of the 2½ inch thick portion are 1-inch thicknesses of lead 136 and 138. Then further lead of about ½ inch thickness extends to the edge of the roof 132. There is also additional lead shielding 180 and 188 of 1-inch thickness on the shield 182 and 184 for which also carry rollers 160 and 154, respectively. The shields 182 and 184 themselves are of 1-inch steel. As illustrated, the equipment vault sits on the ground floor and therefore does not need additional radiation absorbing materials on the bottom portion. If placed on the second floor of a building it is likely that additional lining at the bottom would be required. To determine if additional radiation protection is needed, a survey with a radiation measuring device is carried out for any areas of higher radiation than 0.25 millirems per hour. Then, additional shielding is added to any areas of higher radiation.

While the invention has been illustrated with a specific radiation enclosure, it should be noted that other enclosures within the invention could be formed. The enclosure is large enough that the entrances and exits for the webs are more than the about 8 feet required to dissipate the electron type radiation given off. The x-rays given off are the type of rays requiring the most shielding as they do not dissipate quickly with distance. The need for shielding has prevented previous web devices from being suitable for cloth finishing where thick coats of resin were placed on the cloth, or where cleaning of contamination needs to be carried out frequently. The up time of the equipment is rapidly reduced if contamination can not be easily, quickly and rapidly removed. The invention of allowing cleaning, service and web stringing by a person who is entirely within the radiation chamber is a feature of the instant invention. The large chamber with 8 to 10 feet from the electron beam source to the web exits and web entrances is another novel feature of the invention. The large entrance and exit holes for the web from the vault also are believed novel in the art. The holes for the web are about 2 inches up to about 4 inches in height. Holes of about 4 inches are preferred for ease of stringing the web. The large entrance holes ease the task of stringing the web and also minimize the chance of contact by the web surface which would harm the product. The holes may be angled where passing through the wall to aid radiation control.

Figure 4:
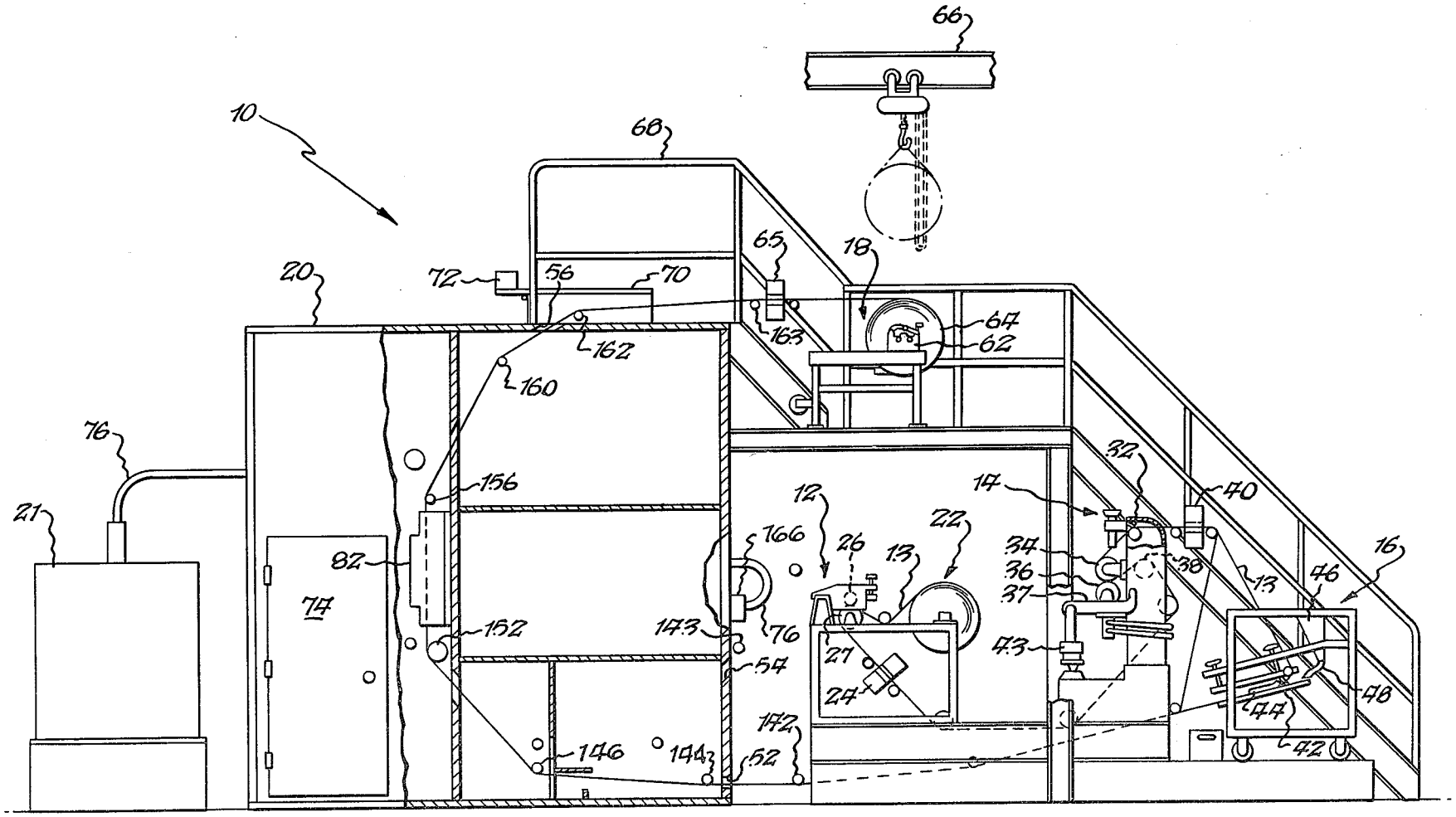
FIG. 4 is a schematic of the apparatus of the invention set up for curing from the back of the web.
Figure 5:
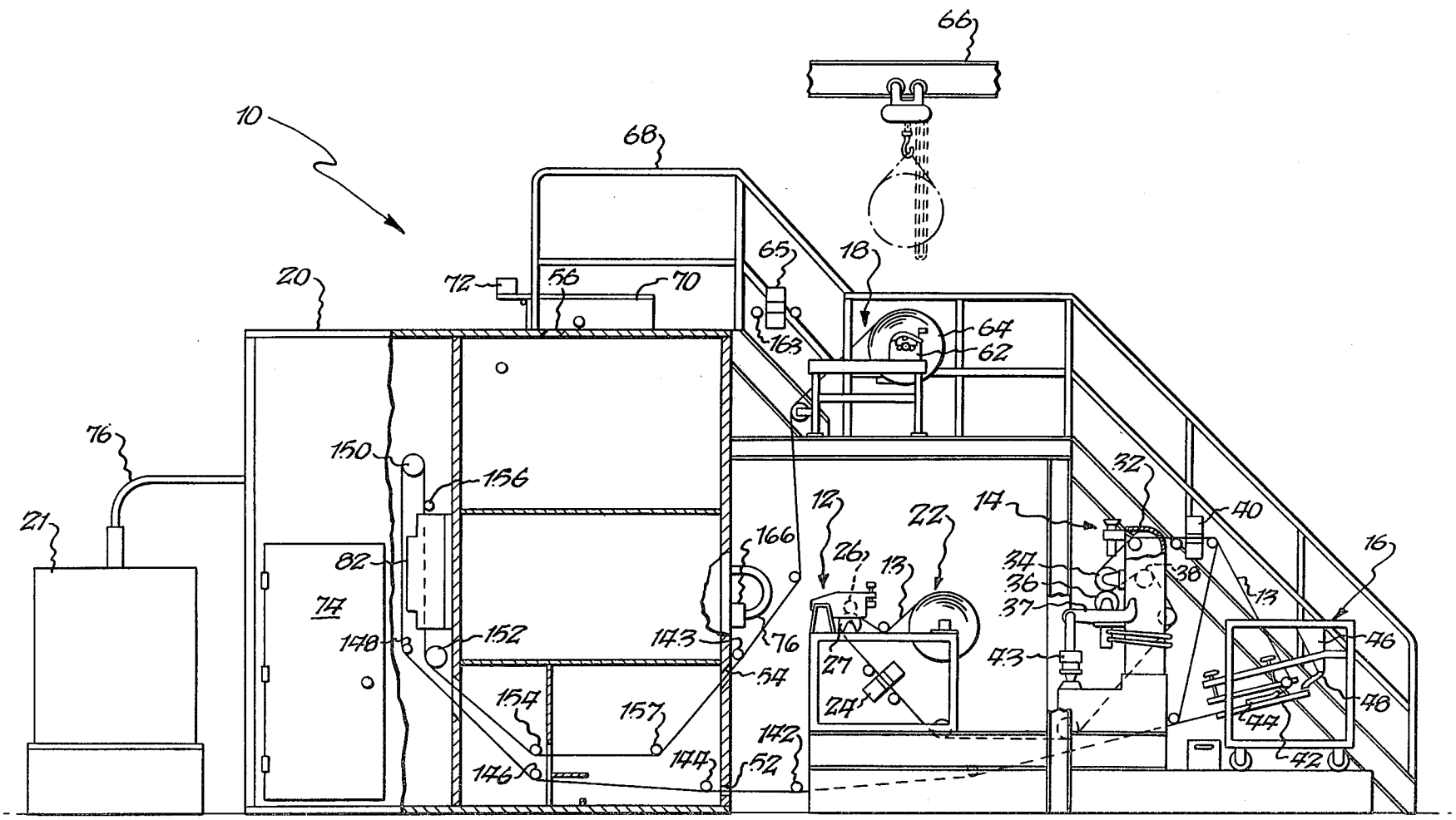
FIG. 5 is a schematic of the apparatus of the invention set up for curing directly onto the wet resin of the coated web.

The arrangement of conveyor rollers within the apparatus of the invention that allows adjustment such that the electron beam may impinge on either the resin wet face or the back surface of a web passing through the device will now be explained with reference to FIGS. 4 and 5. The web enters at 52 after passing under roll 146. The wet resin side here faces downward. Immediately inside opening 52 roller 144 controls movement of the resin treated material for its movement to roller 146. At 146 as shown in FIG. 5 when the wet side is to be directly treated, the web material passes to roller 148, upward to roller 150 and then downward past out of contact roller 156 and through the inerting chamber 82 where electron beam curing takes place. Exiting from the inerting chamber the cured web is now contacted on the cured resin side by roller 152, it then passes to conveyor rollers 154 and 157 prior to exiting through opening 54 over roller 143. The cured web then is led by appropriate rollers or other guide means to winder 64. The instance of a web to be cured by exposure to the electron beam from the side opposite to where the wet resin coat is located is illustrated by FIG. 4. The track followed within the chamber would be entry through aperture 52 followed by passing over rollers 144 and 146 then to roller guide 152 for passage directly upward through inerting chamber 82 and over roller 156 prior to exiting by passing over rollers 160 and 162 as the web passes through aperture 56. The web then moves to take up roller 64 passing through beta gauge 85 and over roller 163. The sealing device 166 where power cable 76 enters the vault is packed with lead packing material to minimize radiation.

The radiation chamber is protected with interlock devices that do not allow activation of the electron beam until all doors are closed and all guards and covers are in place. The chamber also has internal alarms and shut offs to prevent injury by trapping a person inside the vault.

The side of the inner box or chamber that houses the electron beam unit is formed with three bolted panels on sides 104 and 106. Removal of the panels permits easy access for servicing and adjustment of the electron beam unit. The side panels are of 1-inch steel with additional thicknesses of lead towards the end of the gun adjacent the inerting chamber. The service area below the chamber for the gun is also accessed by hinged or sliding steel panels 119 for threading of the web through the device of the invention.

The source of high energy electrons 108 may be any commercially available electron beam unit capable of generating energy of about 175,000 to about 1,000,000 volts. The unit may be either a curtain or scanning electron beam. In one instance it was successfully found that a scanning electron beam unit of a capacity of 500 kw was suitable. A unit of about 300 kw to about 500 kw is suitable for the instant coatings and speeds of up to about 400 feet per minute. The source of high energy radiation could be a nuclear source, but it is not preferred since nuclear control is much more difficult than the electron beam.

Any suitable resins may be utilized for the backing and make coat layers of the invention. Among suitable resins are those described in the above referenced Hesse et al U.S. Pat. No. 4,074,903. The length of cure and amount of radiation needed for cure are a variable depending on the speed of the web, amount of resin and purity of inerting gas in the inerting chamber 82. It is anticipated that web speeds of up to about 400 feet per minute are feasible for electron beam curing.

It is understood that the above-described embodiments are simply illustrative of the invention and that many other embodiments can be devised without departing from the spirit and the scope of the invention. For instance, the thickness of the radiation protection material may be varied depending on the strength of the electron beam gun utilized in the chamber. Further, the simplified access and stringing abilities of the chamber could be utilized without the possibility of multiple ways of exposing the material. The radiation vault could be only used for coated abrasive formation rather than also being used for cloth finishing. Further, a series of radiation vaults each treating a specific layer (i.e., size coat, make coat, face coat, back coat) could be arranged for continuous operation rather than restringing for each coat. Further the apparatus of the invention could be utilized to produce materials other than coated abrasives such as plastic coated fabrics or floor coverings. The apparatus of the invention is particularly suitable for any use wherein an electron beam curable resin is coated onto a floppy backing material of cloth, paper or foil and where the thickness of the coating or added particles on the coating create the likelihood that the machine will require constant adjustment and frequent cleaning and access for threading or repairing broken webs.

While the invention has been described with specific embodiments these are modifications that may be made without departing from the spirit of the invention. For instance, the vault could be formed with more compartments or other radiation absorbing materials, such as cement or the use of more lead lining and thinner steel. Further, the web could be partly carried by conveyors or edge grippers rather than rollers. The paths of webs could be varied depending on location of the coating applicator and the electrostatic grain coats for applying abrasive grain. It is also within the purview of the invention to treat thick resin coating on web backings for other purposes, such as floor coverings, wallpaper and artificial leather. The scope of the invention is not limited to specific illustrations but is defined by the claims.

I claim:

1. In apparatus for curing a wet coating on a running length web, said web being coated on one side only, by irradiating said web selectively from either the coated or uncoated side, means for transporting said web along a selected path without contacting the coated side of the web; an irradiating chamber enclosing a portion of said path, said chamber having an entrance and an exit; a source of high energy electron radiation for directing an electron beam into said chamber substantially perpendicularly to the plane of the path of said web and onto the uncoated side; an additional means located along said selected path upstream of the entrance of said chamber for deflecting said web along a second path around and past said chamber on the side of said chamber opposite said source of high energy electron radiation and back to said selected path downstream of the exit of said chamber; a second additional means downstream of the exit of said chamber for deflecting said web from said second path into the exit of said chamber along said selected path but in the opposite direction; whereby when the web is transported only by the means for transporting said web along a selected path, the web is directly irradiated on the uncoated side, but when it is transported by said means to transport and said additional means it is directly irradiated on the coated side, but in neither case is the coated side contacted by the transport means prior to the irradiation.

2. The apparatus of claim 1 wherein said running length web further comprises abrasive grains.

3. The apparatus of claim 1 further comprising means to coat said wet resin onto said web.

4. The apparatus of claim 3 further comprising means to apply abrasive grain to the wet resin on said web.

5. The apparatus of claim 1, further comprising means to electrostatically deposit abrasive grain onto said web upstream of said chamber.

6. The apparatus of claim 1, wherein said web material is selected from the group consisting of paper, nonwoven fabric, natural fiber cloth and artifical fiber cloth.

7. The apparatus of claim 1, wherein said source of high energy radiation and said irradiating chamber are housed in a radiation absorbing vault.

8. The apparatus of claim 7, wherein said vault comprises at least two openings for a web entering and exiting from the vault and pathways for said web between said openings, said source of high energy electron radiation, an electron absorbing housing for said source of high energy radiation, a shielded service and entry area into said vault for access to said source of high energy radiation and to the means for carrying a web and a target area enclosure for service access to said chamber with the proviso that said target area enclosure and said service and said entry areas are large enough for a person to easily enter, that said housing may be accessed for adjustment by movable panels from said service area and that said vault allows less than 0.25 millirems per hour radiation to escape during operation.

* * * * *